US009234391B2

(12) United States Patent
Belnap et al.

(10) Patent No.: US 9,234,391 B2
(45) Date of Patent: Jan. 12, 2016

(54) SHEAR CUTTER WITH IMPROVED WEAR RESISTANCE OF WC-CO SUBSTRATE

(71) Applicant: SMITH INTERNATIONAL, INC., Houston, TX (US)

(72) Inventors: J. Daniel Belnap, Lindon, UT (US); Georgiy Voronin, Orem, UT (US); Peter T. Cariveau, Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 246 days.

(21) Appl. No.: 13/684,613

(22) Filed: Nov. 26, 2012

(65) Prior Publication Data

US 2013/0133957 A1 May 30, 2013

Related U.S. Application Data

(60) Provisional application No. 61/564,577, filed on Nov. 29, 2011.

(51) Int. Cl.

| | |
|---|---|
| ***E21B 10/55*** | (2006.01) |
| ***E21B 10/46*** | (2006.01) |
| ***B24D 3/06*** | (2006.01) |
| ***B24D 99/00*** | (2010.01) |
| ***E21B 10/573*** | (2006.01) |

(52) U.S. Cl.

CPC . *E21B 10/46* (2013.01); *B24D 3/06* (2013.01); *B24D 99/005* (2013.01); *E21B 10/573* (2013.01)

(58) Field of Classification Search

CPC ... E21B 10/55; E21B 10/573; E21B 10/5735; E21B 2010/564

See application file for complete search history.

(56) References Cited

U.S. PATENT DOCUMENTS

| | | | | |
|---|---|---|---|---|
| 5,348,109 | A | 9/1994 | Griffin | |
| 5,467,669 | A | 11/1995 | Stroud | |
| 5,492,188 | A | 2/1996 | Smith et al. | |
| 5,496,638 | A | 3/1996 | Waldenstrom et al. | |
| 5,541,006 | A | 7/1996 | Conley | |
| 5,697,046 | A | 12/1997 | Conley | |
| 6,216,805 | B1 | 4/2001 | Lays et al. | |
| 6,896,460 | B2 | 5/2005 | Enomoto et al. | |
| 2001/0008190 | A1 | 7/2001 | Scott et al. | |
| 2005/0276717 | A1 | 12/2005 | Fang | |
| 2006/0165993 | A1 * | 7/2006 | Keshavan | 428/408 |
| 2008/0240879 | A1 | 10/2008 | Dourfaye et al. | |
| 2009/0032169 | A1 | 2/2009 | Dourfaye et al. | |
| 2009/0152017 | A1 | 6/2009 | Shen et al. | |
| 2010/0101368 | A1 | 4/2010 | Fang et al. | |
| 2010/0126779 | A1 | 5/2010 | Corbett et al. | |

FOREIGN PATENT DOCUMENTS

WO 2010117823 A2 10/2010

OTHER PUBLICATIONS

Bellin et al., "The current state of PDC bit technology," World Oil, Nov. 2010: pp. 67-71.

* cited by examiner

*Primary Examiner* — Cathleen Hutchins

(57) ABSTRACT

A cutting element having a substrate, an abrasive layer mounted to the substrate at an interface, and a longitudinal axis extending through the abrasive layer and the substrate is disclosed, wherein the substrate has a binder material, a plurality of metal carbide grains bonded together by an amount of the binder material, and at least one binder gradient, and wherein the amount of binder material decreases along at least one direction to form the at least one binder gradient.

25 Claims, 13 Drawing Sheets

SHEAR CUTTER WITH IMPROVED WEAR RESISTANCE OF WC-CO SUBSTRATE

CROSS-REFERENCE TO RELATED APPLICATION

This Application claims the benefit of U.S. Provisional Patent Application Ser. No. 61/564,577 filed on Nov. 29, 2011, which is herein incorporated by reference in its entirety.

BACKGROUND

1. Field of the Invention

Embodiments disclosed herein relate generally to cutting elements for drilling earth formations. More specifically, embodiments disclosed herein relate to cutting elements containing metal carbide substrates.

2. Background Art

In a typical drilling operation, a drill bit is rotated while being advanced into a soil or rock formation. The formation is cut by cutting elements on the drill bit, and the cuttings are flushed from the borehole by the circulation of drilling fluid that is pumped down through the drill string and flows back toward the top of the borehole in the annulus between the drill string and the borehole wall. The drilling fluid is delivered to the drill bit through a passage in the drill stem and is ejected outwardly through nozzles in the cutting face of the drill bit. The ejected drilling fluid is directed outwardly through the nozzles at high speed to aid in cutting, flush the cuttings and cool the cutter elements.

There are several types of drill bits, including roller cone bits, hammer bits and drag bits. Roller cone rock bits include a bit body adapted to be coupled to a rotatable drill string and include at least one "cone" that is rotatably mounted to a cantilevered shaft or journal as frequently referred to in the art. Each roller cone in turn supports a plurality of cutting elements that cut and/or crush the wall or floor of the borehole and thus advance the bit. The cutting elements, either inserts or milled teeth, contact with the formation during drilling. Hammer bits typically include a one piece body with having crown. The crown includes inserts pressed therein for being cyclically "hammered" and rotated against the earth formation being drilled.

Drag bits, often referred to as "fixed cutter drill bits," include bits that have cutting elements attached to the bit body, which may be a steel bit body or a matrix bit body formed from a matrix material such as tungsten carbide surrounded by a binder material. Drag bits may generally be defined as bits that have no moving parts. However, there are different types and methods of forming drag bits that are known in the art. For example, drag bits having abrasive material, such as diamond, impregnated into the surface of the material which forms the bit body are commonly referred to as "impreg" bits. Drag bits having cutting elements made of an ultra hard cutting surface layer or "table" (typically made of polycrystalline diamond material or polycrystalline boron nitride material) deposited onto or otherwise bonded to a substrate are known in the art as polycrystalline diamond compact ("PDC") bits, or more broadly as shear cutter bits. Shear cutter bits drill soft formations easily, but they are frequently used to drill moderately hard or abrasive formations. They cut rock formations with a shearing action using small cutting elements referred to as shear cutters that do not penetrate deeply into the formation. Because the penetration depth is shallow, high rates of penetration are achieved through relatively high bit rotational velocities.

An example of a shear cutter bit is shown in FIG. 1. FIG. 1 shows a rotary drill bit 10 includes a bit body 12 having a cutting end 11 and a threaded pin end 13 for connection to a drill string (not shown). The cutting end 11 of the bit body 12 is formed with a plurality of blades 14, which extend generally outwardly away from a central longitudinal axis of rotation 16 of the drill bit. A plurality of shear cutters 18 having a cutting layer 19 bonded to a carbide substrate 17 are disposed side by side along the length of each blade. The number of shear cutters 18 carried by each blade may vary. The shear cutters are positioned along the leading edges of the bit body blades so that as the bit body is rotated, the shear cutters engage and drill the earth formation. In use, high forces may be exerted on the shear cutters, particularly in the forward-to-rear direction. Additionally, the bit and the shear cutters may be subjected to substantial abrasive forces. In some instances, impact, vibration and erosive forces have caused drill bit failure due to loss of one or more cutters, or due to breakage of the blades.

In a typical shear cutter, a compact of polycrystalline diamond ("PCD") (or other superhard material, such as polycrystalline cubic boron nitride) is bonded to a substrate material, which is typically a sintered metal-carbide, to form a cutting structure. A PCD shear cutter may be formed by placing a mixture of diamond grains or diamond grains and catalyst material on a substrate and subjecting the assembly to high pressure, high temperature ("HPHT") conditions. Alternatively, a pre-formed diamond table may be placed on a substrate and subjected to HPHT conditions to bond the diamond table to the substrate. During the HPHT process, metal binder migrates from the substrate and passes through the diamond grains to promote intercrystalline growth between the diamond grains, binding the diamond grains to each other and binding the formed PCD table to the substrate. In particular, PCD refers to a polycrystalline mass of diamond grains or crystals that are bonded together to form an integral, tough, high-strength mass or lattice. The resulting PCD structure produces enhanced properties of wear resistance and hardness, making PCD materials extremely useful in aggressive wear and cutting applications where high levels of wear resistance and hardness are desired.

Shear cutter substrates are commonly formed from a carbide/metal composite (often referred to as a cermet), which includes hard particles of carbide surrounded by a metal binder, typically cobalt, which acts as a matrix. The individual hard particles thus are embedded in a matrix of a relatively ductile metal such that the ductile metal matrix provides the necessary toughness, while the grains of hard material in the matrix furnish the necessary wear resistance. The ductile metal matrix also reduces crack formation and suppresses crack propagation through the composite material once a crack has been initiated.

Due to its toughness and high wear resistance, cemented tungsten carbide is a common cermet that is used to form cutting element substrates in rock-drilling and earth boring applications. "Cemented tungsten carbide" generally refers to a tungsten carbide composite which comprises tungsten carbide ("WC") grains bonded together by a binder phase. Among the types of tungsten carbide particles that may be used to form a cemented tungsten carbide, for example, include cast tungsten carbide, macro-crystalline tungsten carbide, carburized tungsten carbide and cemented tungsten carbide. In most applications, the binder phase comprises cobalt (Co), nickel (Ni), and/or iron (Fe). However, tungsten carbide grains dispersed in a cobalt binder matrix is the most common form of cemented tungsten carbide currently used for cutting elements in drilling applications, and is typically classified by grades based on the grain size of the tungsten carbide particles used and the cobalt content. However, in some cases, cemented tungsten carbide may be classified by grades based on the cobalt content and a material property such as hardness or wear resistance.

FIG. 2 illustrates the conventional microstructure of a tungsten carbide/metal composite. As shown in FIG. 2, cemented tungsten carbide 20 includes tungsten carbide grains 22 that are bonded to one another by a metal binder phase 24. As illustrated, tungsten carbide grains may be bonded to other grains of tungsten carbide (depending on the metal content), thereby having a tungsten carbide/tungsten carbide interface 26, and/or may be bonded to the metal phase, thereby having a tungsten carbide/metal interface 25. The unique properties of tungsten carbide cermets result from this combination of hard carbide particles with a tougher, ductile metal phase.

In conventional carbide cermets, it is possible to increase the toughness of the composite by increasing the amount of metal binder present in the composite and/or by increasing the carbide grain size. Conversely, the hardness of the carbide cermet may be increased by decreasing the amount of metal binder and/or by decreasing the carbide grain size. Thus, toughness and hardness are inversely related. To utilize both characteristics of toughness and hardness, some prior art cermets have been designed to have areas with higher amounts of binder (increased toughness) and areas with lower amounts of binder (increased hardness) by forming a binder gradient.

For example, U.S. Pat. Nos. 7,699,904 and 7,569,179, which are incorporated herein by reference, describe methods of forming functionally graded materials having a metal matrix phase, such as cobalt, and a hard phase made of at least two chemical elements, such as tungsten and carbon. The functionally graded composites have a continuous gradient of the metal matrix phase that is formed by designing an initial (non-continuous) gradient of one of the chemical elements of the hard phase and then liquid phase sintering the hard phase and metal matrix phase. For example, an initial gradient for tungsten carbide may be formed by creating a first layer deficient in carbon and a second layer enriched with carbon. When the tungsten carbide layers are sintered with the metal matrix phase, the heated conditions cause the carbon atoms to diffuse in a direction from the enriched layer to the deficient layer and atoms of the metal matrix to flow in the same direction as the diffusion.

Other prior art methods of forming continuous gradient of the matrix metal phase may include, for example, creating a graded structure by using two layers with different magnetic saturation numbers, as described in U.S. Pat. No. 5,541,006, and creating a graded structure through a carburizing treatment, as described in U.S. Pat. No. 6,896,460. However, such methods have limitations with respect to the size of gradient that may be formed. In particular, gradients formed using different magnetic saturation may be limited to a metal matrix gradient having only 1-2% difference, and gradients formed by carburization treatments may be limited to small depths of the gradient, as measured from the surface of the treated composite. Also, this process requires formation of an eta ($\eta$) phase (i.e., a complex carbide compound of tungsten, cobalt, and carbon), which has been known in the art as forming brittle grains around WC crystals, and thus, sites for crack initiation and propagation. Thus, this prior art gradient-forming method requires forming a hard phase element deficient layer and a hard phase element enriched layer in order to create a continuous gradient of the matrix metal phase.

Moreover, it has not yet been known to use graded carbides such as the ones described above in a shear cutter substrate, which undergoes HPHT processing to attach an ultra-hard cutting layer to the substrate. Accordingly, there is a need for improved cutting element substrates that have properties of both increased toughness and increased hardness and that may be bonded to an ultra-hard cutting table.

SUMMARY OF INVENTION

In one aspect, embodiments disclosed herein relate to a cutting element that has a substrate, an abrasive layer mounted to the substrate at an interface, and a longitudinal axis extending through the abrasive layer and the substrate, wherein the substrate includes a binder material, a plurality of metal carbide grains bonded together by an amount of the binder material, and at least one binder gradient, wherein the amount of binder material decreases along at least one direction to form the at least one binder gradient.

In another aspect, embodiments disclosed herein relate to a shear cutter drill bit having a bit body comprising a cutting end, a plurality of blades extending outwardly from the bit body, a plurality of shear cutters disposed along the length of each blade, wherein at least one shear cutter includes a substrate, an abrasive layer mounted to the substrate at an interface, and a longitudinal axis extending through the abrasive layer and the substrate, wherein the substrate includes a binder material, and a plurality of metal carbide grains bonded together by an amount of the binder material, and at least one binder gradient, and wherein the amount of binder material decreases along at least one direction to form the at least one binder gradient.

In another aspect, embodiments disclosed herein relate to a method of forming a cutting element that includes sintering together a plurality of metal carbide grains and a metal binder to form a substrate, forming at least one binder gradient in the substrate, wherein the amount of metal binder material decreases along at least one direction to form the at least one binder gradient, and mounting an abrasive layer to the substrate at an interface.

In yet another aspect, embodiments disclosed herein relate to a cutting element having a substrate and an abrasive layer brazed to the substrate at an interface, wherein the substrate has a binder material, a plurality of metal carbide grains bonded together by an amount of the binder material, and a binder gradient formed at the interface.

Other aspects and advantages of the invention will be apparent from the following description and the appended claims.

DETAILED DESCRIPTION

Figure 1:
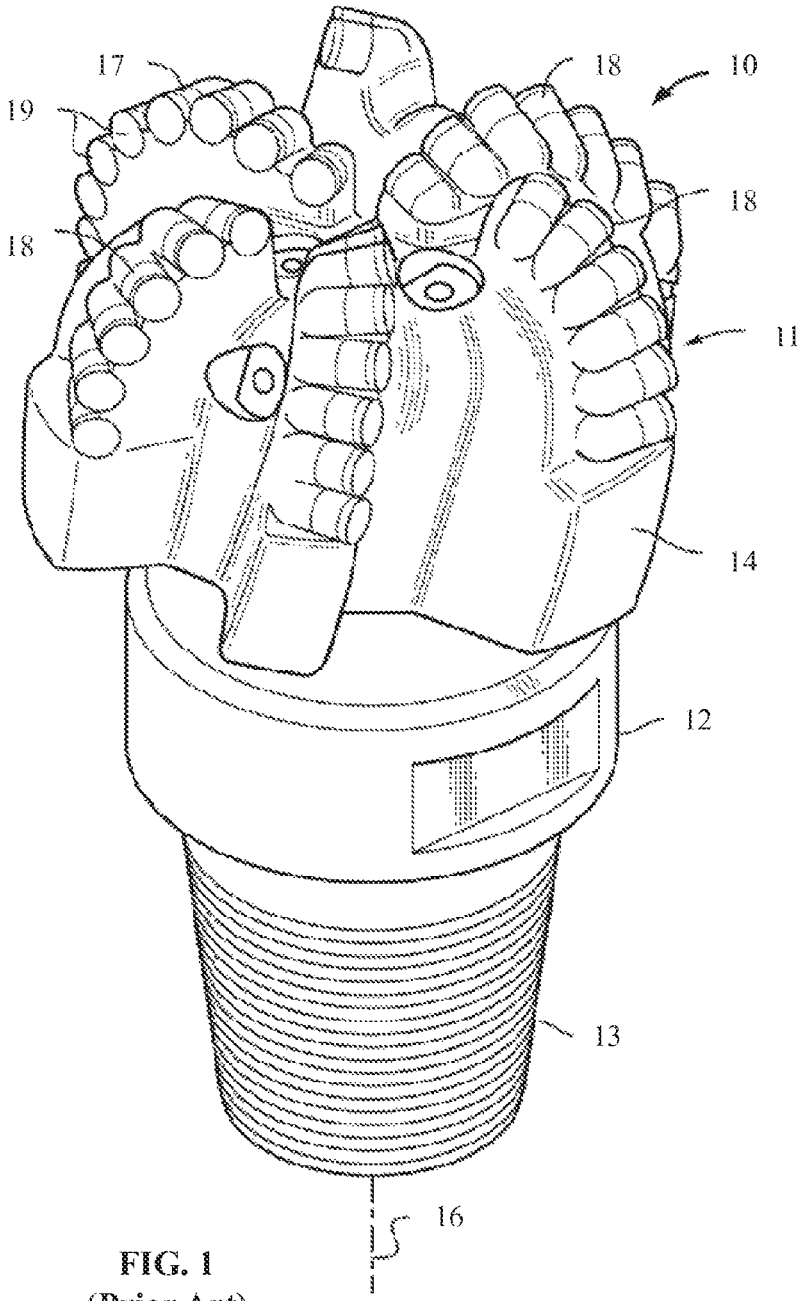
FIG. 1 (Prior Art)
FIG. 1 shows a side view of a conventional drag bit.
Figure 2:
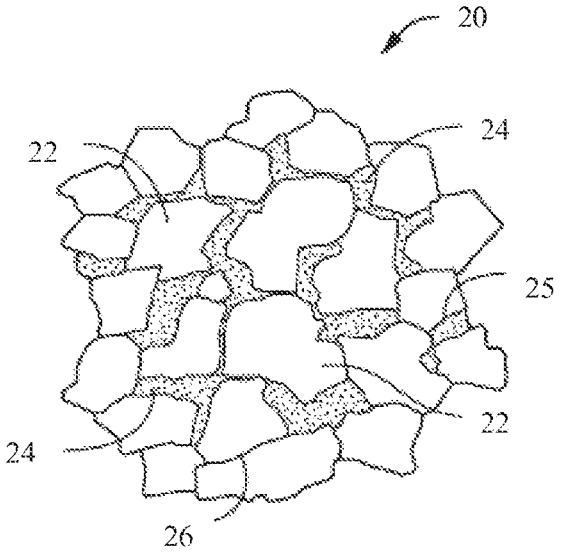
FIG. 2 (Prior Art)
FIG. 2 shows the conventional microstructure of a tungsten carbide/metal composite.

Generally, embodiments disclosed herein relate to shear cutters having improved wear-resistance substrates. In particular, embodiments disclosed herein include carbide substrates having at least one of a binder gradient and a lower nominal amount of binder material.

Substrates Having at Least One Binder Gradient

According to a first aspect of the present disclosure, a shear cutter has an ultra-hard cutting layer bonded to a carbide substrate that nominally has about 12 to 14 percent by weight of binder material, but has been treated to make at least one binder gradient. In such embodiments, although the total amount of binder throughout the substrate may include an amount of binder material that is about 12% to 14% by weight of the substrate, the areas of the substrate having the at least one binder gradient formed therein will include a percent by weight of binder material that is less than the total percent by weight of binder material throughout the substrate. In particular, a carbide substrate may be formed by sintering together a plurality of metal carbide grains and a metal binder, wherein the carbide grains include stoichiometric tungsten carbide (WC), and wherein the binder includes a metal selected from Group VIII elements of the Periodic Table, such as Co, Ni, Fe and alloys thereof. Stoichiometric tungsten carbide includes tungsten carbides having a carbon content in the range of from 6.08 percent to 6.18 percent by weight, based on the weight of tungsten carbide. Other metals of metal carbide grains may be selected from the group of carbides consisting of W, Ti, Mo, Nb, V, Hf, Ta, and Cr carbides.

Methods known in the art of sintering the carbide substrate may include, for example, combining the stoichiometric tungsten carbide powder and metal binder into a mixture to be milled, granulated and then pressed into a green compact. The green compact may then be sintered by vacuum sintering, hot isostatic pressing sintering, microwave sintering, spark plasma sintering, or other means known in the art. During sintering, temperatures may range from 1000 to 1600° C., and in particular from about 1350 to 1500° C. Once the carbide substrate is sintered, it may then be treated to form at least one binder gradient.

As used herein, a binder gradient refers to an amount of binder in a carbide composite that substantially continuously varies with respect to at least one direction within the carbide composite. Binder gradients according to some embodiments of the present disclosure may have a gradient of 1% or more, wherein the amount of binder substantially continuously varies with respect to at least one direction within the carbide composite by 1% or more. For example, in some embodiments, a binder gradient may extend from an outer surface of a substrate to an interior location of the substrate, such that the lowest binder content, or the highest hardness, is at the outer surface of the substrate. In such embodiments, the binder gradient may be 1% by weight or more, such that the difference between the percent of binder content at the interior location of the substrate is different from the percent of binder content at the outer surface by 1 weight percent or more. Additionally, according to some embodiments, a binder gradient may range up to 6% by weight, range between 2% and 4% by weight or between 1% and 2% by weight, depending on the bulk binder content. For example, some embodiments having a higher amount of overall binder content may have larger binder gradients formed therein. Further, in particular embodiments, a shear cutter substrate may be made of a tungsten carbide/cobalt composite (i.e., cermet), wherein the binder gradient is a cobalt gradient formed in the tungsten carbide composite.

A binder gradient may be formed by methods known in the art that do not require the use of an eta-phase, such as described in U.S. Pat. Nos. 7,699,904 and 7,569,179, which are incorporated herein by reference. According to the methods described therein, capillary force acts as the driving mechanism for the binder migrating from one area in a carbide composite to another to form the gradient. For example, in one method, a cobalt gradient may be formed by cobalt migration from a carbide layer having coarser grain sizes to a carbide layer with finer grain size (i.e., from cobalt migration through carbide layers of decreasing carbide grain sizes). According to another method for forming a cobalt gradient, cobalt migrates from a carbide layer with higher cobalt content to a carbide layer with lower cobalt content (i.e., from cobalt migration through carbide layers with decreasing cobalt content).

In a preferred embodiment, a binder gradient may be formed in lower magnetic saturation substrates. Magnetic saturation is the condition when, after a magnetic field strength becomes sufficiently large, further increase in the magnetic field strength produces no additional magnetization in a magnetic material. It has been found that when forming a binder gradient, the binder diffusion mechanism is related to a carbide substrate's magnetic saturation, and larger binder gradients may be formed by using carbide substrates with lower magnetic saturation. For example, a larger binder gradient (i.e., greater difference in the amount of binder between two opposite reference points, such as the core of a substrate and the outer surface of the substrate) may be formed in carbide substrates having 80% magnetic saturation than in carbide substrates having 90% magnetic saturation.

In a tungsten carbide-cobalt substrate according to the present disclosure, magnetic saturation may be lowered during the sintering process as the cobalt binder phase melts and forms a liquid phase. While the binder is in a liquid phase, tungsten and/or carbon from the tungsten carbide phase may dissolve into the liquid binder phase. Upon introduction of the non-magnetic components, such as dissolved tungsten, into the binder phase, the magnetic saturation decreases. The magnetic saturation of the carbide substrate is structure insensitive and is affected by the purity of the cobalt binder phase—and is specifically affected by the amount of tungsten in solution. The magnetic saturation values of high quality carbide may range between 80% and 100%, with 80% representing the point at which brittle eta phases in the carbide binder begin to form. According to some embodiments of the present disclosure, a carbide substrate may have a magnetic saturation ranging from 85% to 95%. The presence of carbon does not affect the magnetic saturation levels, and is inversely related to the amount of tungsten in solution. For example, a magnetic saturation value of close to 100% represents a binder phase consisting of a higher than stochiometric amount of carbon (>6.18 wt %) and 0 wt % of dissolved tungsten. As magnetic saturation approaches 100%, carbon reaches the point of saturation, and precipitated carbon (also known as C porosity) can be present in the microstructure. Conversely a carbide material with a magnetic saturation level close to 80% will have a lower than stoichiometric amount of carbon (<6.08 wt %) and approximately 12 wt % dissolved tungsten. The magnetic saturation of a carbide substrate may be controlled during the sintering process by various methods, such as by adjusting the composition of the mixture used to form the substrate and by controlling the time, temperature, pressure, carbon and oxygen content in the sintering environment, etc. Exemplary methods of altering the magnetic saturation of a substrate may be found in U.S. Patent Publication No. 2010/0126779, which is incorporated herein by reference.

Figure 7:
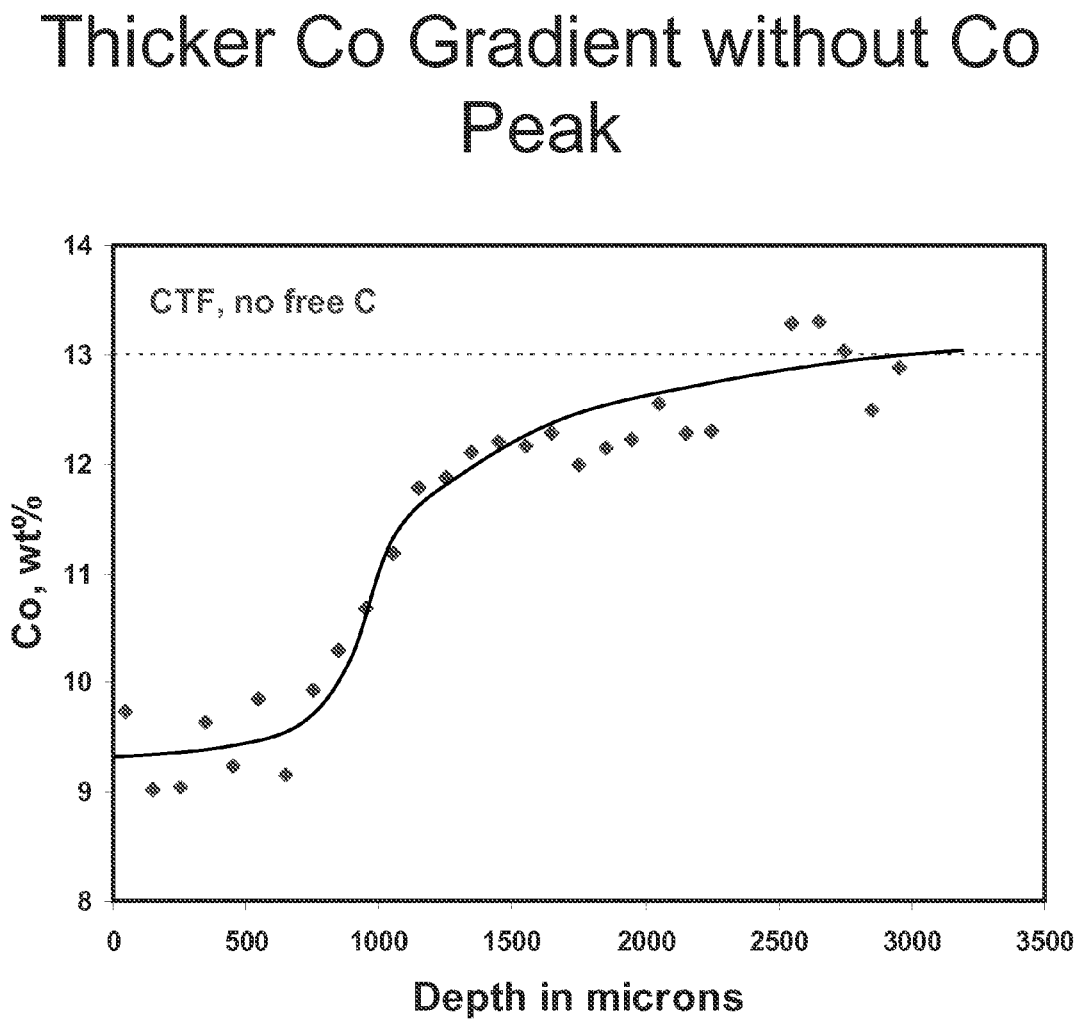
FIG. 7 shows a graph of a binder gradient formed within a substrate according to embodiments of the present disclosure.
Figure 8:
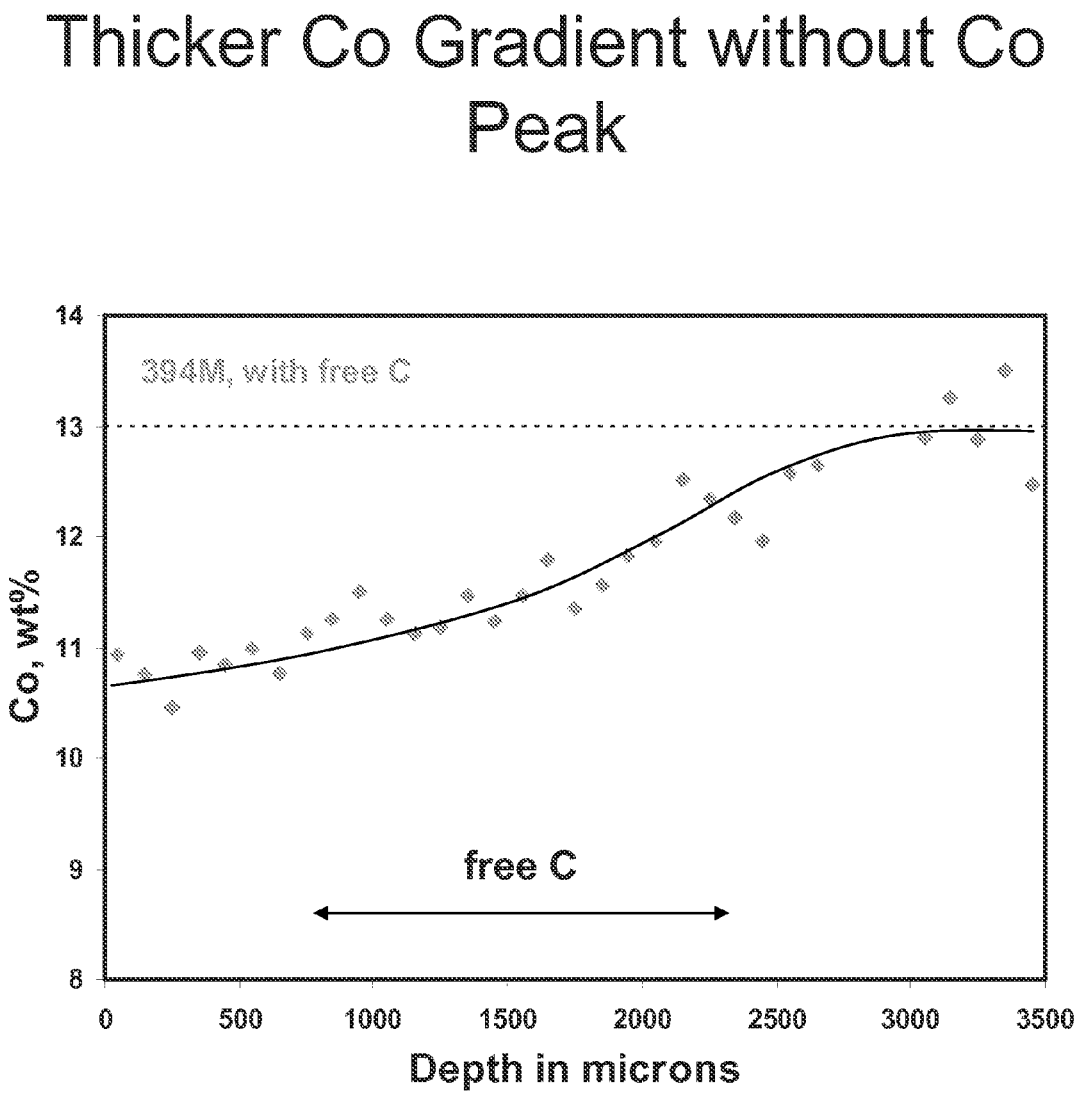
FIG. 8 shows a graph of a binder gradient formed within a substrate according to embodiments of the present disclosure.

Referring now to FIGS. 7 and 8, each graph represents a binder gradient formed in carbide substrates having different magnetic saturations. Particularly, in each graph, the amount of cobalt binder is measured in terms of weight percent at various depths from a surface of a carbide substrate. As shown in FIG. 7, a carbide substrate having a 13 percent by weight nominal cobalt binder composition has a binder gradient formed therein, extending a depth from a surface of the substrate. At the surface, the amount of cobalt binder present may be about 9.4 percent by weight. The amount of cobalt binder increases with respect to depth from the surface to the nominal amount of cobalt binder (about 13 percent by weight) at a depth from the surface of about 3 mm. Further, the carbide substrate material tested for FIG. 7 has a lower than stoichiometric amount of carbon and no precipitated carbon (free C). In such material, a higher weight percent of tungsten may dissolve into the binder phase of the substrate, thus decreasing the magnetic saturation of the substrate and creating a large binder gradient (from about 9.4 wt. percent to about 13 wt. percent over a depth of about 3 mm). FIG. 8 also represents a carbide substrate having a 13 percent by weight nominal cobalt binder composition and a binder gradient formed therein, extending a depth from a surface of the substrate. However, the carbide substrate material of FIG. 8 has a higher than stoichiometric amount of carbon, such that free carbon is present throughout the substrate. In such material, a lower weight percent of tungsten may dissolve into the binder phase of the substrate, thus increasing the magnetic saturation of the substrate and creating a smaller binder gradient (from about 10.75 wt. percent to about 13 wt. percent over a depth of about 3 mm) than the binder gradient shown in FIG. 8. Although the binder gradients formed in the substrates of FIGS. 7 and 8 are shown as being formed through a depth of 3 mm, binder gradients of the present disclosure may be formed through other depths, such as depths ranging between 1 and 3 mm in some embodiments. For example, in some embodiments having a substrate that is brazed to an abrasive layer, a binder gradient may be formed therein having a depth less than 1 mm. Further, in some embodiments having a substrate upper surface that is sintered to an abrasive layer, the upper surface may have no binder gradient formed therein.

Once the base carbide is sintered, it is possible to induce a binder gradient by subsequent processing under high temperature conditions in an appropriate atmosphere, as disclosed in U.S. Pat. Nos. 7,699,904 and 7,569,179. In this processing step, the sintered carbide is subjected to a furnace atmosphere with an engineered ratio of methane ($CH_4$) and hydrogen ($H_2$). Depending on the ratios of methane and hydrogen used and the amount of carbon in solution in the binder, the furnace atmosphere can be tailored to either add or remove carbon from the binder phase according to the methane decomposition reaction $CH_4 \rightarrow C+2H_2$ or the reverse methane formation reaction $C+2H_2 \rightarrow CH_4$. In a preferred embodiment the carbide is first sintered in a less than 100% magnetic saturation condition such that the binder composition is below the saturation point with respect to carbon. A preferred amount of magnetic saturation is less than 95%, and more preferably less than 90%. The sintered carbide is then processed in an environment such that the methane decomposition reaction takes place on the surfaces of the carbide, thus inducing a carbon gradient in the material. As stated previously, cobalt liquid migration occurs from regions of high carbon concentration to regions of low carbon concentration, which can be used to form cobalt gradients that are either higher or lower than the bulk cobalt amount. With a carbon gradient present in the material that is higher at the surface than on the interior, the cobalt then begins to migrate away from the surfaces into the interior of the substrate. Conversely, with a carbon gradient that is lower at the surface than in the interior of the substrate, cobalt liquid migration can flow from the interior to the exterior to form a gradient that is higher at the surface than in the interior of the substrate.

According to embodiments of the present disclosure, a carbide substrate having a binder gradient formed therein may then be attached to an ultra hard cutting layer by HPHT processing to form a shear cutter without substantially altering the gradient. An ultra hard cutting layer may include, for example, an ultra-hard abrasive material such as natural or synthetic diamond, polycrystalline diamond (PCD), or thermally stable polycrystalline diamond (TSP). For example, a diamond cutting layer may be bonded to a graded carbide substrate of the present disclosure by placing a mixture of diamond particles or diamond particles and catalyst material adjacent to the substrate and subjecting the assembly to HPHT processing. The HPHT processing conditions used are sufficient to cause crystalline bonds to form between the diamond particles and for the diamond material to bond to the substrate at least in part due to the infiltration of the metal binder from the substrate into the cutting layer. In other embodiments, a previously partially or fully sintered diamond cutting layer may be placed adjacent to the substrate and subjected to HPHT processing such that binder material from the substrate infiltrates into the diamond layer and bonds the diamond layer to the substrate. Alternatively, the substrate may be brazed to the ultra hard cutting layer using a thermal cycle appropriate to the specific braze alloy without the use of high pressures.

Although gradients can be induced on any surface of the substrate material, it is not always advantageous to place gradients on all surfaces. For example, in the case where the substrate is used for HPHT sintering, a carbon gradient formed on the interface surface with a PCD material may make the cobalt infiltration which occurs during the HP/HT sintering process more difficult because this infiltration must occur against the carbon/cobalt gradient, thus increasing the amount of time required for infiltration and subsequent sintering of the PCD material. In such embodiments, a shield (described below) may be used to cover and prevent gradient formation at the substrate interface.

Figure 9:
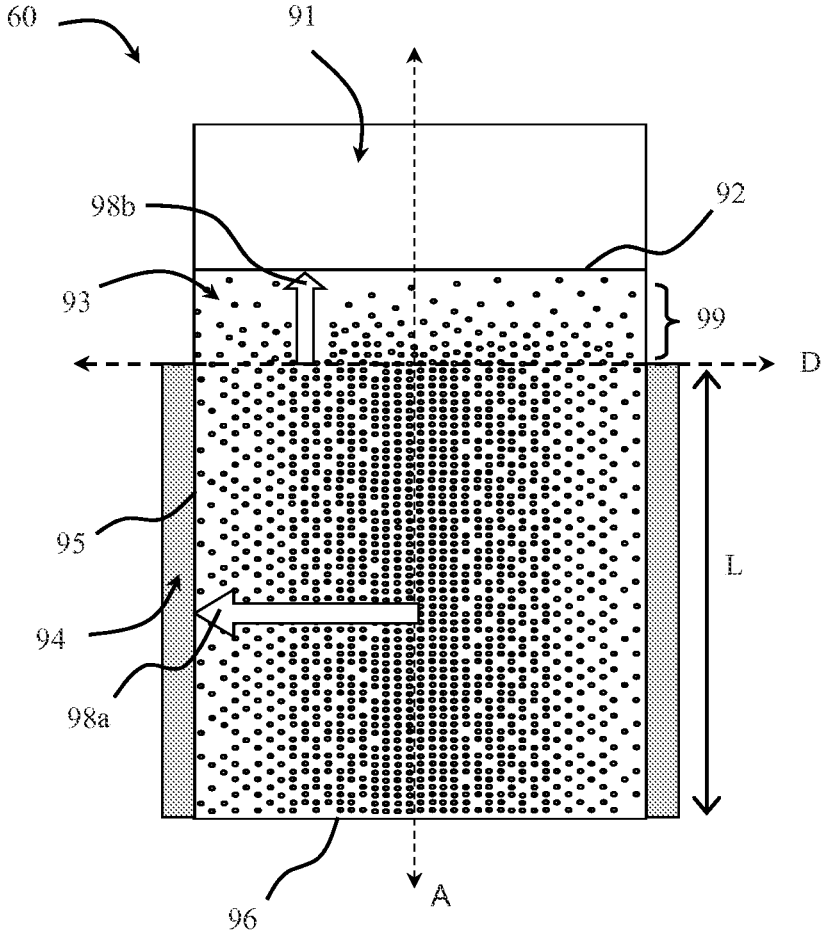
FIG. 9 shows a cross-sectional view of a cutting element according to embodiments of the present disclosure.

For example, FIG. 9 shows a cross sectional view of a cutting element 90 according to embodiments of the present disclosure having a shield 94. Particularly, the cutting element has a cutting layer 91 attached to a substrate 93 at an interface 92. The substrate 93 has a radial binder gradient **98*a* and an axial binder gradient 98*b*. Radial binder gradient 98*a* is formed radially between the longitudinal axis A and the outer surface 95 of the substrate 93, such that a comparatively larger amount of binder material is at the longitudinal axis A, a comparatively smaller amount of binder material is at the outer surface 95, and a gradually decreasing amount of binder material is between the longitudinal axis A and the outer surface 95. However, according to other embodiments, radial binder gradients may be formed between the outer surface of a substrate and a depth into the substrate, such that the gradient does not extend to the longitudinal axis of the cutting element. Further, the radial binder gradient 98*a* may extend along a length L of the substrate 93, such that at each position along the length L of the substrate 93, the radial binder gradient is formed between the longitudinal axis A and the outer surface 95. Although the length L of the radial binder gradient 98***a* shown in FIG. 9 extends from a bottom surface 96 of the substrate to an upper region 99 of the substrate, radial binder gradients according to other embodiments may extend different lengths along the substrate.

Referring still to FIG. 9, an axial binder gradient 98*b* is formed in an upper region 99 of the substrate, extending a depth D below the interface 92 into the substrate 93, such that a comparatively larger amount of binder material is at the depth D, a comparatively smaller amount of binder material is at the interface 92, and a gradually decreasing amount of binder material is between the depth D and the interface 92. Although the axial binder gradient 98*b* shown in FIG. 9 is formed between the depth D and the interface 92 along each position of the plane extending at the depth D, other embodiments may have axial binder gradients formed along only a portion of the plane at a depth from the interface surface. As shown in FIG. 9, a shield 94 may be used to cover the radial binder gradient 98*a* formed in the substrate during formation of the axial binder gradient 98*b*. The shield 94 may be a layer of protective powder, such as an inert powder (e.g., aluminum oxide), or may be a structured layer of protective material. Other materials the shield may be made of include, for example, silicon nitride, aluminum nitride and silicon carbide. Further, according to other embodiments, a shield may be used to protect one or more primary binder gradients formed in various positions of the substrate to protect the primary binder gradient(s) from substantially altering during formation of additional binder gradients at various other positions in the substrate.

The rate of infiltration of cobalt during the HP/HT sintering is proportional to the WC grain size, i.e., a slow rate of infiltration with smaller grain sizes and a rapid rate of infiltration with larger grain sizes. In carbide in which the grain size is less than 3 microns it is preferred that there is no carbon gradient on the interface surface of the carbide, due to concurring difficulties with the kinetics of infiltration and sintering. Thus, in such embodiments, a shield may be used at and/or near the interface surface during formation of a gradient(s) within a substrate to inhibit the interface surface from forming a gradient.

However, there are cases where cobalt infiltration from the substrate is very rapid and uncontrolled during the HP/HT sintering process. Uncontrolled infiltration is common when the average substrate WC grain size is larger than about 3 microns, and becomes less controlled with increasing grain size. When rapid infiltration occurs, it tends to create interface defects during HP/HT process which can in turn lead to premature failure of the products. Having a carbon/cobalt gradient at the interface of a larger grain sized substrate provides an uphill component opposing the infiltration, and thereby a means of controlling the problem of rapid and uncontrolled infiltration. Therefore, in the cases where larger grain sized substrates are employed it can be advantageous to have a gradient on the interface surface.

Alternatively, in the case of substrates used for brazing to an ultra hard material layer without high pressure, it can be useful to have cobalt gradients depending on the specific braze material and wetting properties. For example, according to embodiments having a substrate brazed to an ultra hard material cutting layer, a binder gradient may be formed within the substrate, extending from the substrate/cutting layer interface to a depth below the interface. A binder gradient formed at the interface surface may be substantially uniform along the depth (as shown in FIG. 9), or alternatively, the depth of the binder gradient may vary. For example, according to some embodiments, a binder gradient may extend a from the interface surface to a first depth at a first position along the interface and from the interface surface to a second depth at a second position along the interface. A binder gradient may extend a depth between 1 and 3 mm, less than 1 mm, less than 50 microns, or between 10 and 20 microns. Further, the binder gradient may have a gradient of 1% or more. According to other embodiments, a binder gradient may extend along multiple directions (e.g., radially and axially). In such embodiments, binder gradients may be formed throughout the substrate to increase wear resistance along the outer side of the substrate. In particular embodiments having a substrate brazed to an ultra hard cutting layer and a binder gradient(s) formed at the interface, comparatively smaller binder gradients may be formed at the outer side surfaces of the substrate than binder gradients formed from the center of the interface in order to increase wear resistance of the substrate outer side surfaces and protect the corners of the substrate from erosion. It may also be advantageous to have a gradient with a higher amount of cobalt on the substrate surface that is in contact with the braze material. A gradient formed on a braze surface may be used with or without a corresponding side surface gradient.

Advantageously, attaching a diamond or other ultra hard material layer to the graded carbide substrate improves the wear resistance significantly, allowing the carbide substrate to function longer as a component in a shear cutter. In particular, although the substrate portion of the cutter may not perform a cutting function, it may still be fully protected from erosion due to hydraulic fluids which contain abrasive solids. Thus, improved wear resistance may increase the life of the cutter.

Figure 3:
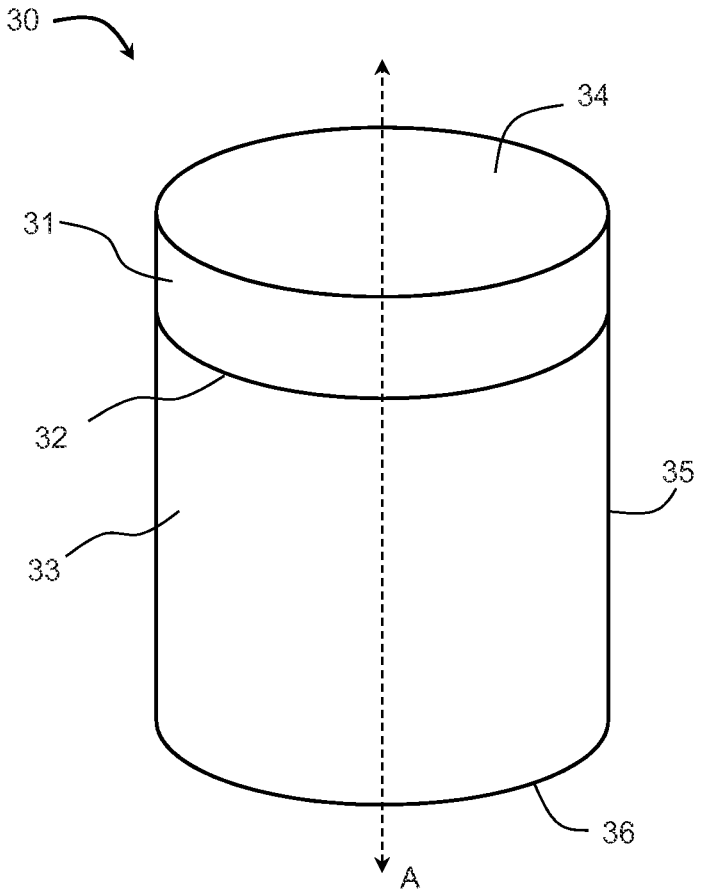
FIG. 3 shows a shear cutter according to embodiments of the present disclosure.

Referring to FIG. 3, an embodiment of a shear cutter 30 made according to the present disclosure includes a cutting layer 31 bonded to a substrate 33 at an interface 32. The shear cutter 30 has a cutting surface 34 that contacts and cuts a borehole, an outer side surface 35, and a bottom 36 opposite from the cutting surface 34. A longitudinal axis A extends lengthwise, or axially, through the shear cutter, typically through the cutter's center. The substrate 33 includes a binder gradient according to the present disclosure that extends along a length of the substrate 33. Exemplary substrates made with a binder gradient are described below and shown in FIGS. 4A-6. Further, although shown as having a cylindrical shape in FIG. 3, cutting elements of the present disclosure may have geometries other than that specifically described above. For example, a cross-section perpendicular to the longitudinal axis of a shear cutter may have an oval or egg-shape. Additionally, a substrate may have a planar or non-planar interface with the cutting layer.

Figure 4A:
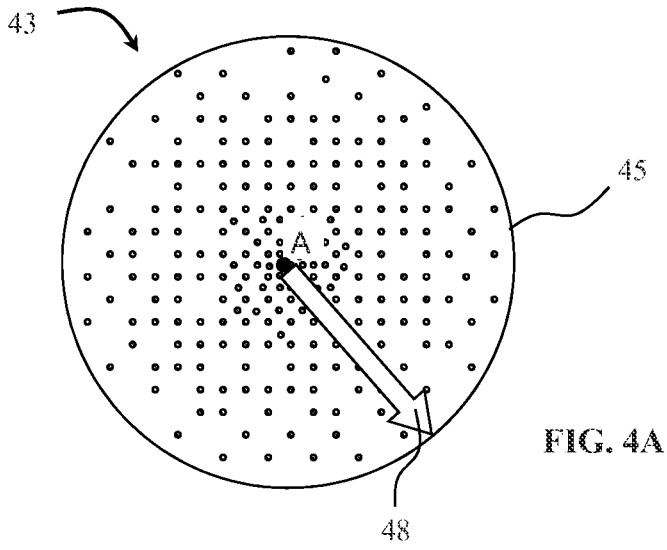
FIGS. 4A and 4B show cross-sectional views of a substrate having a binder gradient.
Figure 4B:
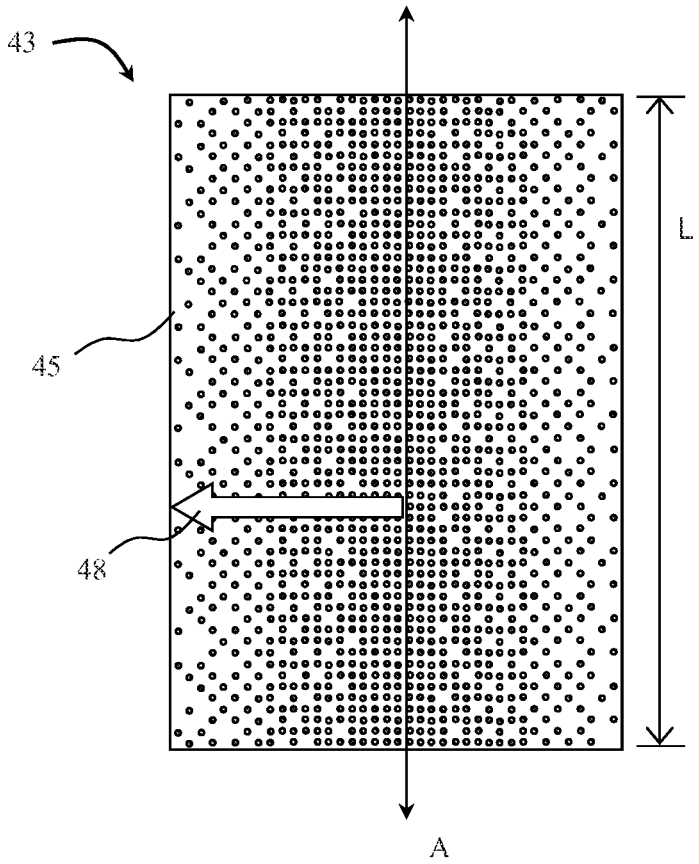

Referring now to FIGS. 4A and 4B, cross-sectional views of a substrate 43 having a binder gradient 48 are shown. In particular, FIG. 4A shows a cross-section of the substrate 43 along a plane perpendicular to the longitudinal axis A, and FIG. 4B shows a cross-sectional view of the substrate 43 along a plane parallel to and intersecting the longitudinal axis A. The binder gradient 48 is formed from the longitudinal axis A to an outer surface 45 of the substrate 43, such that the amount of binder material surrounding the carbide particles of the substrate gradually decreases from the longitudinal axis A toward the outer surface 45 of the substrate. Stated differently, the binder gradient 48 formed from the longitudinal axis A to the outer surface 45 has a larger amount of binder material at the longitudinal axis A (which in FIGS. 4A and 4B is at the core of the substrate 43), a smaller amount of binder material at and proximate to the outer surface 45, and a substantially continuously varying amount of binder material between the core and outer surface of the substrate. A binder gradient having a decreasing amount of binder material along a radial direction of a substrate, e.g., from the longitudinal axis or a depth from the outer surface to the outer surface of a substrate, may also be referred to herein as a radial binder gradient. Further, a radial binder gradient 48 may extend axially, along a length L of the substrate 43, such that at each position along the length L of the substrate 43, the radial binder gradient is formed from the longitudinal axis A to the outer surface 45. As shown in FIG. 4B, the radial binder gradient 48 may extend the entire length L of the substrate.

Figure 5:
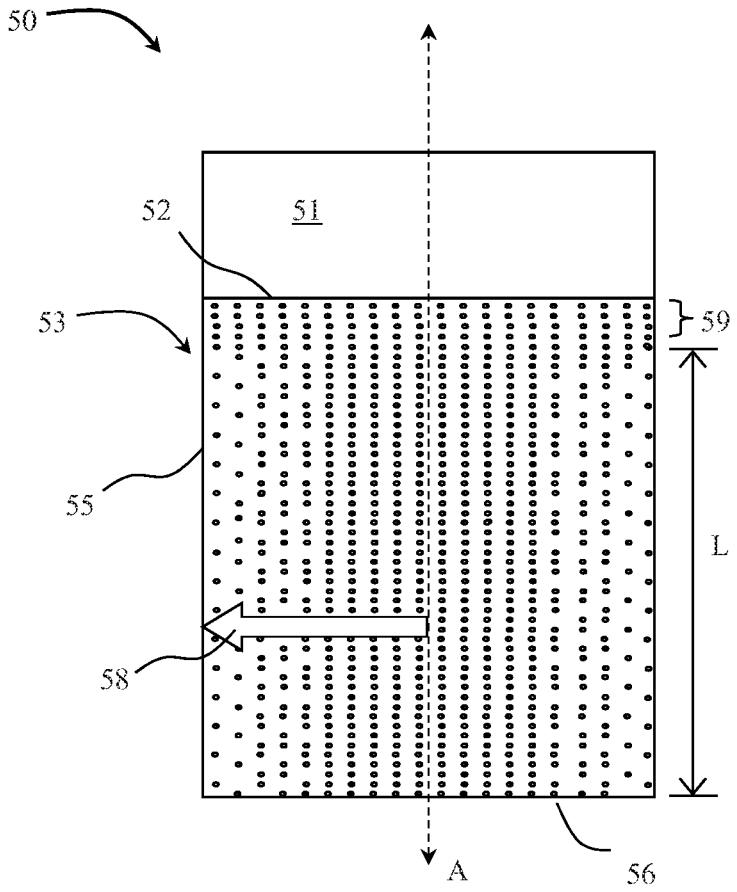
FIG. 5 shows a cross-sectional view of a substrate according to an embodiment of the present disclosure.
Figure 6:
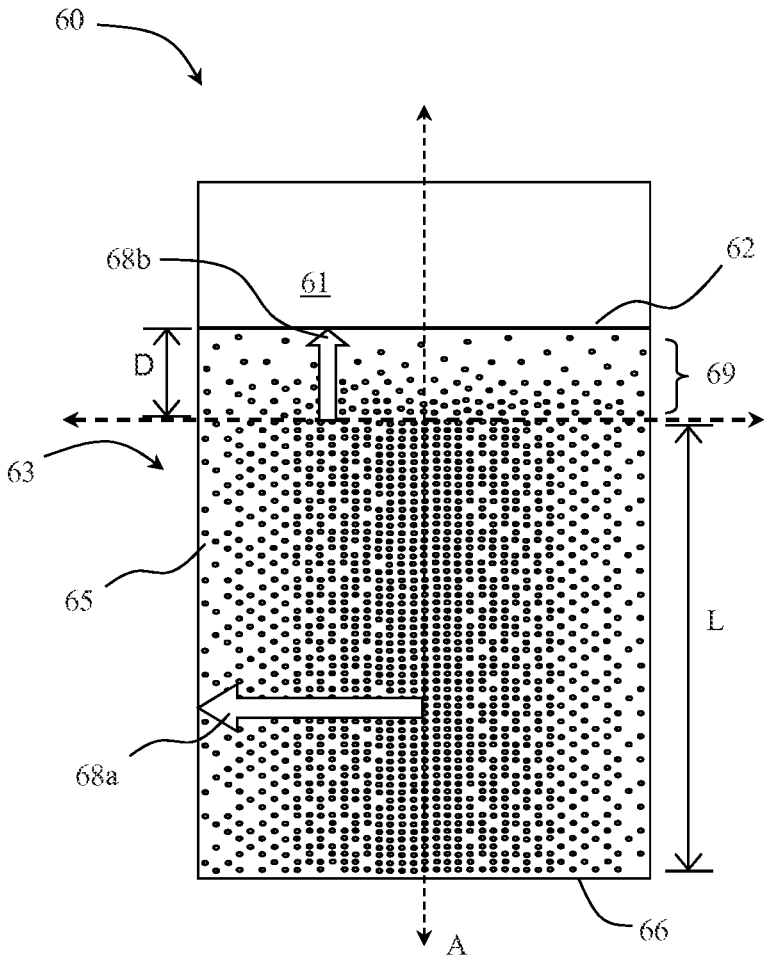
FIG. 6 shows a cross-sectional view of a substrate according to another embodiment of the present disclosure.

In preferred embodiments, such as shown in FIG. 5, a radial binder gradient 58 may extend along a length L shorter than the entire length of the substrate 53. In particular, FIG. 5 shows a shear cutter 50 having a cutting layer 51 bonded to a substrate 53 at an interface 52. The substrate 53 has a radial binder gradient 58 formed between the longitudinal axis A and the outer surface 55 of the substrate 53, such that a comparatively larger amount of binder material is at the longitudinal axis A, a smaller amount of binder material is at the outer surface 55, and a gradually decreasing amount of binder material is between the longitudinal axis A and the outer surface 55. Further, the radial binder gradient may extend along a length L of the substrate 53 measured from an upper region 59 of the substrate 53 proximate to the interface 52. The upper region 59 extends a depth below the interface 52 into the substrate 53, and comprises a substantially uniform concentration of binder material, i.e., the upper region 59 proximate to the interface 52 has a substantially uniform binder content. As shown, the radial binder gradient 58 extends along the length L of the substrate 53 from the upper region 59 to the bottom 56 of the substrate 53, such that at each position along the length L of the substrate 53, the radial binder gradient is formed between the longitudinal axis A and the outer surface 55.

Figure 10:
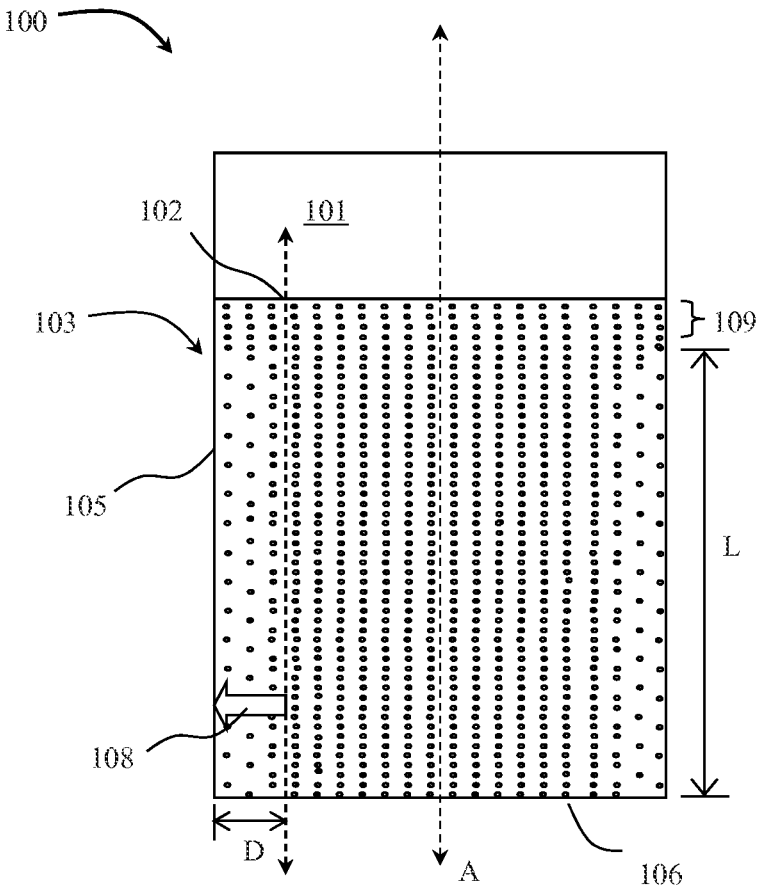
FIG. 10 shows a cross-sectional view of a cutting element according to embodiments of the present disclosure.

According to other embodiments, a radial binder gradient may be formed from the outer surface a depth into the substrate that does not extend all the way to the longitudinal axis of the substrate. For example, referring to FIG. 10, a shear cutter 100 has a cutting layer 101 bonded to a substrate 103 at an interface 102. The substrate 103 has a radial binder gradient 108 formed between the outer surface 105 of the substrate and a depth D from the outer surface of the substrate 103, such that a comparatively larger amount of binder material is at the depth D from the outer surface, a smaller amount of binder material is at the outer surface 105, and a gradually decreasing amount of binder material is between the depth D and the outer surface 105. The depth D of the radial binder gradient may range from 1 to 3 mm in some embodiments, less than 1 mm in other embodiments, less than 50 microns in other embodiments, and between 10 and 20 microns in yet other embodiments. Further, the radial binder gradient 108 may extend along a length L of the substrate 103 measured from an upper region 109 of the substrate 103 proximate to the interface 102. The upper region 109 extends a depth below the interface 102 into the substrate 103, and comprises a substantially uniform concentration of binder material, i.e., the upper region 109 proximate to the interface 102 has a substantially uniform binder content. As shown, the radial binder gradient 108 extends along the length L of the substrate 103 from the upper region 109 to the bottom 106 of the substrate 103, such that at each position along the length L of the substrate 103, the radial binder gradient is formed between the longitudinal axis A and the outer surface 105. However, according to other embodiments, a radial binder gradient may extend the entire length of the substrate.

In yet other embodiments, a binder gradient may be formed along multiple directions through a substrate, such as radially between a core and the outer surface of a substrate and axially between the core and the interface surface of the substrate. For example, referring now to FIG. 6, a shear cutter 60 has a cutting layer 61 attached to a substrate 63 at an interface 62. The substrate 63 has a radial binder gradient 68*a* and an axial binder gradient 68*b*. Radial binder gradient 68*a* is formed radially between the longitudinal axis A, which is also located through the core of the substrate 63, and the outer surface 65 of the substrate 63, such that a comparatively larger amount of binder material is at the longitudinal axis A, a smaller amount of binder material is at the outer surface 65, and a gradually decreasing amount of binder material is between the longitudinal axis A and the outer surface 65. Further, the radial binder gradient 68*a* may extend along a length L of the substrate 63 measured from a bottom 66 of the substrate to an upper region 69 of the substrate 63, such that at each position along the length L of the substrate 63, the radial binder gradient is formed between the longitudinal axis A and the outer surface 65. However, according to some embodiments, a radial binder gradient may be formed from the outer surface of the substrate a depth into the substrate that does not extend all the way to the longitudinal axis of the substrate.

The upper region 69 extends a depth D below the interface 62 into the substrate 63, and comprises an axial binder gradient 68*b*. Axial binder gradient 68*b* is formed between the depth D and the interface 62, such that a comparatively larger amount of binder material is at the depth D, a comparatively smaller amount of binder material is at the interface 62, and a gradually decreasing amount of binder material is between the depth D and the interface 62. Axial binder gradient 68*b* extends across a plane P perpendicular to the longitudinal axis A, such that at each position along plane P in the upper region 69, the binder gradient is formed between the depth D and the interface 62.

Figure 11:
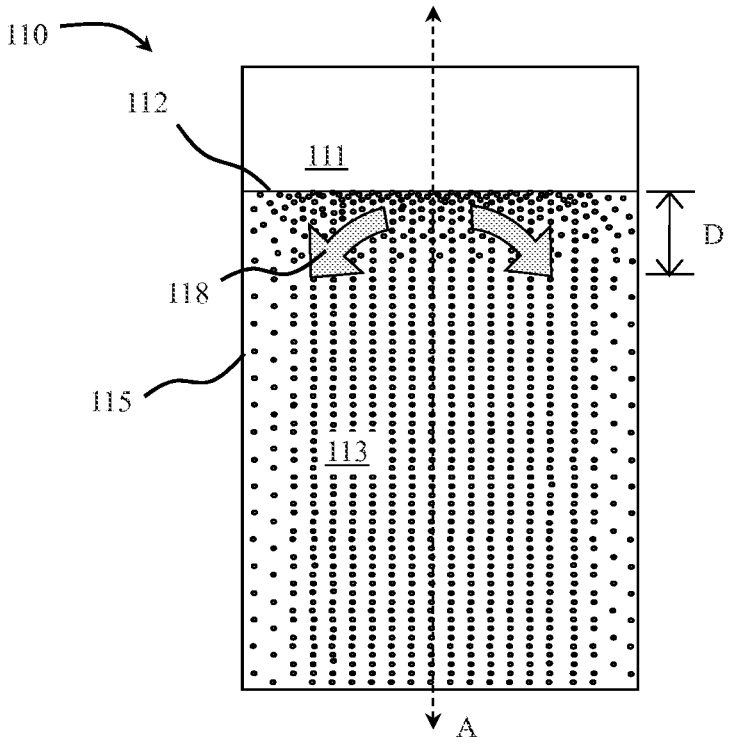
FIG. 11 shows a cross-sectional view of a cutter according to embodiments of the present disclosure.

Furthermore, embodiments of the present disclosure may include a substrate having a binder gradient that varies in depth from a substrate surface. For example, referring to FIG. 11, a cross-sectional view of a shear cutter 110 having a cutting layer 111 brazed to a substrate 113 at an interface 112 and a longitudinal axis A extending therethrough are shown. The substrate 113 has a binder gradient 118 formed therein a depth D from the interface 112, wherein the depth D may vary up to 3 mm from the interface 112. As shown, the binder gradient 118 may extend in an axial and radial direction away from the longitudinal axis A and toward from the outer surface 115 of the cutter, such that the binder gradient forms a dome-like shape within the substrate. Particularly, a comparatively smaller amount of binder material is near the outer surface 115 of the substrate at the depth D from the interface 112, a larger amount of binder material is at the longitudinal axis A near the interface 112, and a gradually decreasing amount of binder material is between the two limits. However, according to other embodiments, the binder gradient may extend in an axial and radial direction toward the longitudinal axis and away from the substrate outer surface, such that the binder gradient forms a dip-like shape within the substrate. In such embodiments, a comparatively larger amount of binder material may be near the longitudinal axis and a depth from the interface, a smaller amount of binder material is at the outer surface near the interface, and a gradually decreasing amount of binder material is between the two limits. The depth D of a binder gradient may range from 1 to 3 mm in some embodiments, less than 1 mm in other embodiments, less than 50 microns in other embodiments, and between 10 and 20 microns in yet other embodiments. Advantageously, by using less binder material at the edge of the substrate (formed between the outer surface and interface surface of the substrate), the substrate edges may have increased wear resistance, thus protecting the cutter from erosion at the substrate/cutting layer interface.

Figure 12A:
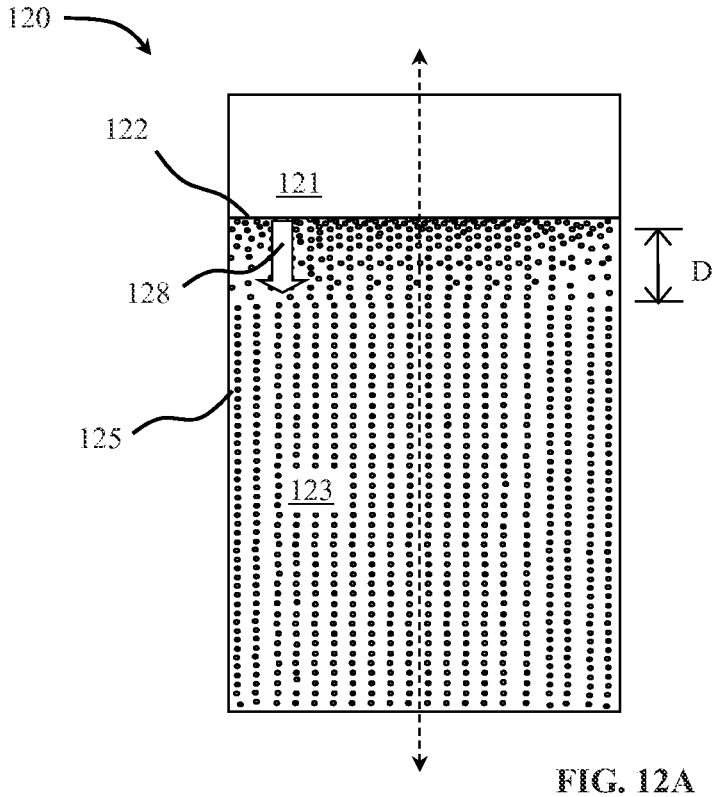
FIGS. 12A and 12B show cross-sectional views of cutters according to embodiments of the present disclosure.
Figure 12B:
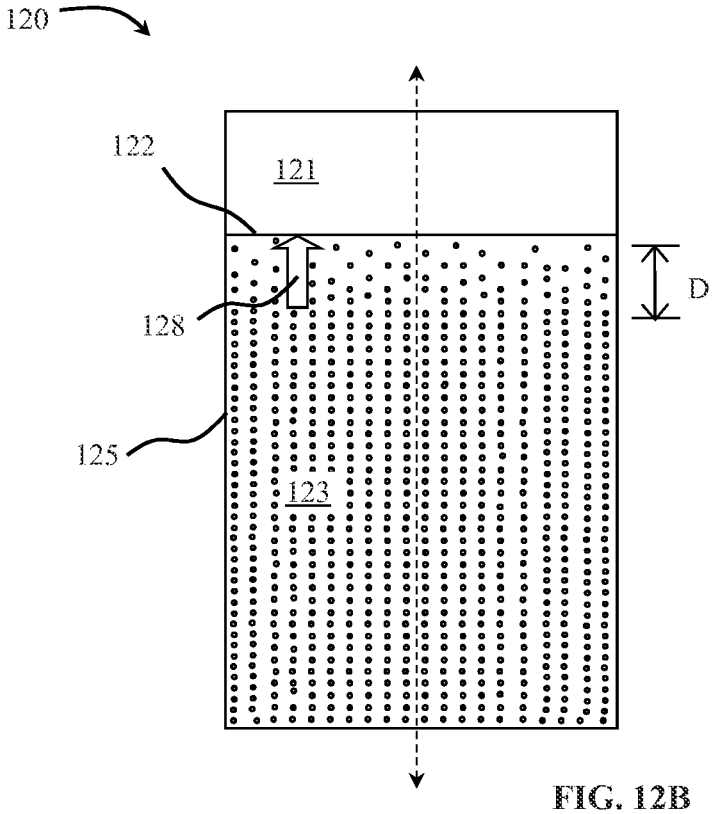

Referring now to FIGS. 12A and 12B, a shear cutter 120 may have a cutting layer 121 attached to a substrate 123 at an interface 122, wherein the substrate 123 has a binder gradient 128 formed therein a depth D from the interface 122. As shown in FIG. 12A, the binder gradient 128 may extend axially from the interface 122 to the depth D, such that the amount of binder material at the interface 122 is larger than the bulk amount of binder material throughout the entire substrate 123. In particular, a comparatively smaller amount of binder material is at the depth D, a comparatively larger amount of binder material is at the interface 122, and a gradually decreasing amount of binder material is between the interface 122 and the depth D. Thus, in such embodiments, the interface 122 may be referred to as being binder enhanced. As shown in FIG. 12B, the binder gradient 128 may extend axially from the depth D to the interface 122, such that the amount of binder material at the interface 122 is less than the bulk amount of binder material throughout the entire substrate 123. In particular, a comparatively larger amount of binder material is at the depth D, a comparatively smaller amount of binder material is at the interface 122, and a gradually decreasing amount of binder material is between the depth D and the interface 122. Thus, in such embodiments, the interface 122 may be referred to as being binder depleted.

Substrates Having a Lower Nominal Amount of Binder

As discussed above, a substrate of the present disclosure may be formed of a carbide cermet having about 12 to 14 percent by weight of binder (e.g., cobalt), based on the total weight of the substrate. However, in other embodiments of the present disclosure, the binder material may form less than 12% by weight of the substrate. For example, the amount of binder material in a substrate of the present disclosure may range from 5 to 11 percent by weight, based on the total weight of the substrate.

The particle sizes of the metal carbide may include large carbide particles having a size greater than 6 microns (e.g., ranging from 8 to 16 microns), small carbide particles having a size of 6 microns or less (e.g., ranging from 1 to 6 microns), or sub-micron sized carbide particles. Further, carbide particles are typically faceted, but may be spherical or non-spherical (e.g., crushed).

In an exemplary sintering process, a carbide powder, such as tungsten carbide, and a metal binder powder, such as cobalt, may be mixed together. The mixture may be milled and granulated to form pellets, which may then be pressed into a green compact. The green compact may be sintered by vacuum sintering, hot-isostatic pressing sintering, microwave sintering, spark plasma sintering, etc. Once the substrate is sintered, a diamond layer may be formed on or bonded to the surface of the substrate by HPHT processing methods described above.

Advantageously, by forming a substrate with less than the conventional amount of binder (approximately 12 to 14%), the wear resistance, and in particular, the hardness, abrasion resistance, corrosion resistance, and erosion resistance, of the substrate may be increased, and thus extend the useful life of the final shear cutter. Using less than the conventional amount of binder to form a carbide substrate may also bring the coefficient of thermal expansion of the substrate closer to that of the diamond layer that is attached to the substrate to form a shear cutter. Advantageously, by reducing the difference between the coefficients of thermal expansion of the substrate and the diamond layer, thermal stresses formed at the interface of the shear cutter may be reduced.

Substrates Having a Lower Nominal Amount of Binder and at Least One Binder Gradient According to other embodiments of the present disclosure, the substrate of a shear cutter may have both of at least one binder gradient and a binder content of less than 12 percent by weight, based on the total weight of the substrate. In particular, substrates have a lower nominal amount of binder may be formed as described above, by sintering a mixture of metal carbide and metal binder, wherein the amount of metal binder mixed with metal carbide grains is less than 12 percent by weight. For example, a substrate made with a lower nominal amount of binder may have an amount of binder ranging from 5 to 11 percent by weight, or in particular, ranging from 6 to 9 percent by weight. Further, at least one binder gradient may be formed in the substrate having a lower nominal amount of binder by methods known in the art and described above, such as by capillary force, wherein the binder migrates from one area in a carbide composite to another to form the gradient. Thus, in such embodiments, although the total amount of binder throughout the substrate may include an amount of binder material that is less than 12% by weight of the substrate, the areas of the substrate having the at least one binder gradient formed therein will include a percent by weight of binder material that is less than the total percent by weight of binder material throughout the substrate. Binder gradients formed in a substrate having a lower nominal amount of binder (i.e., substrates having a binder content of less than 12 percent by weight) may be radial or axial binder gradients, as shown in FIGS. 4A-6.

In embodiments having a lower nominal amount of binder and at least one binder gradient, a shear cutter may have a substrate, an abrasive layer mounted to the substrate at an interface, and a longitudinal axis extending through the abrasive layer and the substrate. The substrate includes a binder material and a plurality of metal carbide grains bonded together by an amount of the binder material, wherein the nominal amount of binder material is less than 12 percent by weight of the substrate, and wherein the binder material forms at least one binder gradient. As used herein, a binder gradient refers to an amount of binder material that decreases along at least one direction. The binder gradient may have a gradient of 1% by weight or more, wherein the weight percent of binder material at the low binder content part of the binder gradient is different from the high binder content part of the binder gradient by 1 wt % or more.

According to some embodiments, the amount of binder material may decrease from the longitudinal axis to an outer surface of the substrate to form a radial binder gradient, wherein the radial binder gradient extends a length along the substrate. A radial binder gradient may extend the entire length of the substrate, or extend a length along the substrate from a bottom of the substrate to an upper region of the substrate. An upper region refers to a portion of a substrate that extends from the interface of a shear cutter to a depth into the substrate. In embodiments having an upper region, the upper region may have a substantially uniform amount of binder material from the longitudinal axis to the outer surface of the substrate, or alternatively, the binder material in the upper region may decrease from the depth of the substrate to the interface to form an axial binder gradient.

A binder composition, including a binder gradient and the amount of binder present in a substrate, may be determined by methods known in the art, such as energy dispersive spectroscopy (EDS), wavelength dispersive spectroscopy (WDS), x-ray fluorescence (XRF), inductively coupled plasma (ICP), or wet chemistry techniques.

A substrate formed according to the embodiments described herein having a lower nominal amount of binder and at least one binder gradient may then be attached to an abrasive layer by HPHT processing, as described above, to form a shear cutter. The abrasive layer may be selected from the group consisting of natural diamond, synthetic diamond, polycrystalline diamond, and thermally stable polycrystalline diamond, for example.

Conventional shear cutters commonly experience large amounts of wear by erosion. This can limit the useful cutter life, especially in markets where the cutters are used in bit rebuilds. Advantageously, by forming a shear cutter having a WC-Co substrate with a lower amount of cobalt in and near the outer surface regions, additional wear resistance in the substrate outer surface may be achieved, thus increasing erosion resistance and the useful life of the cutter. Further, a cutter with the substrate fully intact allows the cutter to be reused in the same bit by re-heating the braze that joins it to the bit, then rotating the cutter to a new position, and then allowing the braze to cool. Alternatively, the cutter can also be removed from the bit and placed in another bit by a similar procedure.

While the invention has been described with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

What is claimed is:

1. A cutting element, comprising:
- a substrate;
- an abrasive layer mounted to the substrate at an interface; and
- a longitudinal axis extending through the abrasive layer and the substrate;
- wherein the substrate comprises:
  - a binder material;
  - a plurality of metal carbide grains bonded together by an amount of the binder material;
  - an upper region extending from the interface to a depth of the substrate, wherein the amount of binder material decreases along at least one direction of the longitudinal axis to form a first binder gradient; and
  - a lower region extending from the upper region toward the bottom of the substrate, wherein the lower region comprises a radial binder gradient and a constant binder concentration along the longitudinal axis.

2. The cutting element of claim 1, wherein the amount of binder material in the lower region decreases from a second depth below an outer surface of the substrate to the outer surface of the substrate to form the radial binder gradient.

3. The cutting element of claim 2, wherein the second depth ranges from 1 to 3 mm.

4. The cutting element of claim 1, wherein the amount of binder material in the lower region decreases from the longitudinal axis to an outer surface of the substrate to form the radial binder gradient.

5. The cutting element of claim 4, wherein the lower region extends the from the upper region to the bottom of the substrate.

6. The cutting element of claim 1, wherein the upper region of the substrate comprises a substantially uniform amount of binder material from the longitudinal axis to the outer surface of the substrate.

7. The cutting element of claim 1, wherein the amount of binder material in the upper region decreases from the first depth of the substrate to the interface to form an axial binder gradient.

8. The cutting element of claim 1, wherein the abrasive layer is selected from the group consisting of polycrystalline diamond and thermally stable polycrystalline diamond.

9. The cutting element of claim 1, wherein the total amount of binder material throughout the substrate comprises 12% to 14% by weight of the substrate.

10. The cutting element of claim 1, wherein the total amount of binder material throughout the substrate comprises less than 12% by weight of the substrate.

11. The cutting element of claim 1, wherein the abrasive layer is brazed to the substrate.

12. A shear cutter drill bit, comprising:
- a bit body comprising a cutting end;
- a plurality of blades extending outwardly from the bit body;
- a plurality of shear cutters disposed along the length of each blade, wherein at least one shear cutter comprises:
  - a substrate;
  - an abrasive layer mounted to the substrate at an interface; and
  - a longitudinal axis extending through the abrasive layer and the substrate;
  - wherein the substrate comprises:
    - a binder material; and
    - a plurality of metal carbide grains bonded together by an amount of the binder material;
    - an upper region extending from the interface to a depth of the substrate, wherein the amount of binder material decreases along at least one direction of the longitudinal axis to form a first binder gradient; and
    - a lower region extending from the upper region toward the bottom of the substrate, wherein the lower region comprises a radial binder gradient and a constant binder concentration along the longitudinal axis.

13. The drill bit of claim 12, wherein the amount of binder material in the lower region decreases from a second depth from an outer surface of the substrate to the outer surface of the substrate to form the radial binder gradient.

14. The drill bit of claim 13, wherein the second depth ranges from 1 to 3 mm.

15. The drill bit of claim 12, wherein the amount of binder material in the lower region decreases from the longitudinal axis to an outer surface of the substrate to form the radial binder gradient.

16. The drill bit of claim 15, wherein the radial binder gradient extends from a bottom of the substrate to the upper region of the substrate.

17. The drill bit of claim 12, wherein the upper region of the substrate comprises a substantially uniform amount of binder material from the longitudinal axis to the outer surface of the substrate.

18. The drill bit of claim 12, wherein the amount of binder material in the upper region decreases from the depth of the substrate to the interface to form an axial binder gradient.

19. The drill bit of claim 12, wherein the total amount of binder material throughout the substrate comprises 12% to 14% by weight of the substrate.

20. The drill bit of claim 12, wherein the total amount of binder material throughout the substrate comprises less than 12% by weight of the substrate.

21. The drill bit of claim 12, wherein the abrasive layer is brazed to an interface surface of the substrate.

22. A cutting element, comprising:

a substrate; and an abrasive layer brazed to the substrate at an interface;

wherein the substrate comprises:

a binder material;

a plurality of metal carbide grains bonded together by an amount of the binder material;

a first binder gradient formed at the interface to a first depth; and a lower region extending from the first depth to a bottom surface of the substrate, wherein the lower region comprises a radial binder gradient and a constant binder concentration along a longitudinal axis of the cutting element.

23. The cutting element of claim 22, wherein the amount of binder material at the interface is less than the total amount of binder material throughout the substrate.

24. The cutting element of claim 22, wherein the amount of binder material at the interface is larger than the total amount of binder material throughout the substrate.

25. The cutting element of claim 22, wherein the amount of binder material in the lower region increases from an outer surface of the substrate to a depth from the outer surface of the substrate.

* * * * *